US009080276B2

(12) United States Patent
Peterson et al.

(10) Patent No.: US 9,080,276 B2
(45) Date of Patent: Jul. 14, 2015

(54) WASHING MACHINE OUT OF BALANCE DETECTION

(75) Inventors: Gregory A. Peterson, South Barrington, IL (US); Thomas J. Sheahan, Oakwood Hills, IL (US)

(73) Assignee: Nidec Motor Corporation, St. Louis, MO (US)

( * ) Notice: Subject to any disclaimer, the term of this patent is extended or adjusted under 35 U.S.C. 154(b) by 977 days.

(21) Appl. No.: 13/167,554

(22) Filed: Jun. 23, 2011

(65) Prior Publication Data

US 2011/0314616 A1 Dec. 29, 2011

Related U.S. Application Data

(60) Provisional application No. 61/358,280, filed on Jun. 24, 2010.

(51) Int. Cl.

| | |
|---|---|
| ***D06F 37/20*** | (2006.01) |
| ***D06F 37/30*** | (2006.01) |
| ***D06F 39/00*** | (2006.01) |
| ***D06F 35/00*** | (2006.01) |

(52) U.S. Cl.

CPC ..... *D06F 37/203* (2013.01); *D06F 35/007* (2013.01); *D06F 37/30* (2013.01); *D06F 37/304* (2013.01); *D06F 39/003* (2013.01); *D06F 2202/10* (2013.01); *D06F 2222/00* (2013.01)

(58) Field of Classification Search

CPC ..... D06F 37/203; D06F 37/30; D06F 37/304; D06F 2202/10; D06F 2222/00; D06F 39/003

USPC ..... 8/159; 68/12.02, 12.04, 12.06, 140

See application file for complete search history.

(56) References Cited

U.S. PATENT DOCUMENTS

| | | | |
|---|---|---|---|
| 5,561,990 | A | 10/1996 | Berkcan et al. |
| 5,713,221 | A | 2/1998 | Myers et al. |
| 6,282,965 | B1 | 9/2001 | French et al. |

(Continued)

FOREIGN PATENT DOCUMENTS

| | | | |
|---|---|---|---|
| EP | 1 167 609 | A1 | 6/2000 |
| EP | 1 857 583 | A1 | 5/2007 |
| WO | 2007/114671 | A2 | 10/2007 |

OTHER PUBLICATIONS

Partial International Search Report corresponding to PCT Application No. PCT/US2011/041706, mailed Oct. 14, 2011 (5 pages).

*Primary Examiner* — Joseph L Perrin
*Assistant Examiner* — Levon J Shahinian
(74) *Attorney, Agent, or Firm* — Maginot, Moore & Beck LLP

(57) ABSTRACT

A method of operating a washing machine to detect unbalanced loads has been developed. The method includes operating a motor to rotate a tub holding a load at a first rotational rate that is below a threshold rotational rate, identifying a mass of the load, operating the motor to rotate the tub at a second rotational rate that is above the threshold rotational rate, identifying a power applied to the motor to continue rotation of the tub at the second rotational rate, obtaining an out of balance mass value from a memory with reference to the power applied to the motor, second rotational rate, and identified mass, identifying a maximum rate for the tub with reference to the out of balance mass value, and operating the motor to rotate the tub at a rate that is less than or equal to the maximum rate.

9 Claims, 5 Drawing Sheets

(56) References Cited

U.S. PATENT DOCUMENTS

| | | | | |
|---|---|---|---|---|
| 6,381,791 | B1 | 5/2002 | French et al. | |
| 6,393,918 | B2 | 5/2002 | French et al. | |
| 6,640,372 | B2 | 11/2003 | Ciancimino et al. | |
| 6,715,175 | B2 | 4/2004 | Ciancimino et al. | |
| 7,246,397 | B2 | 7/2007 | Kim et al. | |
| 7,591,038 | B2 | 9/2009 | Murray et al. | |
| 7,905,122 | B2 | 3/2011 | Murray et al. | |
| 2001/0052265 | A1 | 12/2001 | French et al. | |
| 2006/0242768 | A1* | 11/2006 | Zhang et al. | 8/159 |
| 2009/0106913 | A1* | 4/2009 | Suel et al. | 8/159 |

* cited by examiner

WASHING MACHINE OUT OF BALANCE DETECTION

PRIORITY CLAIM

This application claims priority to U.S. Provisional Application Ser. No. 61/358,280, which is entitled "Washing Machine Out of Balance Detection," and was filed on Jun. 24, 2010; the contents of which are incorporated herein by reference in their entirety.

TECHNICAL FIELD

This application relates generally to machines having rotating containers that hold a load of material, and, in particular, to washing machines having rotating tubs that hold clothing or other materials.

BACKGROUND

Many washing machine designs include a rotating tub that holds clothing or other articles for washing. The tub also holds fluid, typically water and detergent, that is used in the washing process. During the washing process the tub rotates at various speeds depending upon the operating mode of the washing machine. For example, during an agitation phase the drum may rotate at a comparatively low speed and reverse rotational direction frequently. During a spin cycle, the tub typically rotates at a much higher rate to drain excess water from the tub.

As the rotational rate of the tub increases, the centripetal acceleration of the tub urges the load in the tub against a wall of the tub. In one operating mode, the mass of the load in the tub distributes in a substantially uniform manner around the tub. When the load is uniformly balanced, the tub can rotate at various operational speeds without generating undue vibration that can cause the washing machine to move or damage components in the washing machine. However, when a portion of the mass of the load is distributed in an uneven manner in the tub, the washing machine can exhibit unwanted vibration and "walk" or move in response to vibrational forces generated by the rotating tub. The uneven distribution of the load is referred to interchangeably as an "out of balance" or "imbalanced" load. The magnitude of the vibrational forces generated as the tub rotates with an out of balance load increases as the rate of rotation increases, so most of the unwanted vibration occurs when the tub rotates at a high rate of speed, such as during a spin cycle.

Existing techniques are known to identify an out of balance load in a tub that is rotating at comparatively low rates of rotation based on a measured torque of a motor that rotates the tub. However, as the rotational rate of the tub increases, the tub begins to move laterally within the washing machine in addition to rotating. Washing machines typically include a suspension to accommodate and dampen the lateral movement of the tub. When the tub undergoes lateral movement, the methods that measure torque to identify an out of balance load become inaccurate.

One method for identifying an imbalanced load at high speeds is described in U.S. Pat. No. 6,393,918. The '918 patent describes a method for comparing a measured electrical power used to accelerate a tub in a washing machine to a "standard" acceleration power level expected for operation of the washing machine. Challenges remain in determining what the "standard" power level for a washing machine should be, and in determining out of balance loads when a washing machine rotates a tub at a substantially constant rotational speed. Improved methods of identifying out of balance loads in washing machines operating at high rotational speeds would be beneficial.

SUMMARY

In one embodiment, a method of operating a washing machine has been developed. The method includes operating a motor to rotate a tub holding a load at a first rotational rate, the first rotational rate being less than a first predetermined threshold rotational rate and being greater than a rotational rate that enables the load to remain in contact with an inner surface of the rotating tub, identifying a torque applied by the motor to continue to rotate the tub at the first rotational rate, identifying a mass of the load with reference to the torque and the first rotational rate, operating the motor to rotate the tub at a second rotational rate, the second rotational rate being greater than the first predetermined threshold rotational rate, identifying an electrical power level applied to the motor to continue rotation of the tub at the second rotational rate, obtaining an out of balance mass value from a memory with reference to the identified electrical power level applied to the motor, the second rotational rate, and the identified mass, identifying a maximum rotational rate for the tub with reference to the out of balance mass value, and operating the motor to rotate the tub at a third rotational rate that is less than or equal to the identified maximum rotational rate.

In another embodiment, a washing machine has been developed. The washing machine includes a rotatable tub having a volume for holding a load, a suspension operatively connected to the tub, the suspension being configured to dampen linear movement of the tub, an electrical motor operatively connected to the rotatable tub and configured to rotate the tub at a plurality of rotational rates, a power sensor configured to identify an amount of electrical power consumed by the motor during rotation of the tub, and a controller operatively connected to the motor, power sensor, and a memory. The controller is configured to operate the motor to rotate the tub holding a load at a first rotational rate, the first rotational rate being less than a first predetermined threshold rotational rate and being greater than a rotational rate that enables the load to remain in contact with an inner surface of the rotating tub, identify a torque applied by the motor to continue rotation of the tub at the first rotational rate, identify a mass of the load with reference to the torque and the first rotational rate, operate the motor to rotate the tub at a second rotational rate, the second rotational rate being above the first predetermined threshold rotational rate, identify an electrical power level applied to the motor to continue rotation of the tub at the second rotational rate, identify an out of balance mass value of the load with reference to the electrical power level applied to the motor, the second rotational rate, and the identified mass of the load, identify a maximum rotational rate for the tub with reference to the out of balance mass value and the identified mass of the load, and operate the motor to rotate the tub at a third rotational rate that is less than or equal to the identified maximum rotational rate.

In another embodiment, a method of characterizing a washing machine having a rotating tub has been developed. The method includes operating a motor to rotate the tub at a predetermined rotational rate that enables the tub to move in a linear manner with respect to a suspension, the tub holding a load having a first predetermined mass and an object having a second predetermined mass, the load being configured to distribute in a substantially uniform manner on an internal surface of the tub in response to rotation of the tub and the object being configured to generate an unbalanced force on the tub in response to rotation of the tub, identifying an electrical power level applied to the motor to continue rotation of the tub at the predetermined rotational rate, and storing a value corresponding to the second predetermined mass in the memory in association with the predetermined rotational rate, the first predetermined mass of the load, and the identified electrical power level applied to the motor to continue rotation of the tub at the predetermined rotational rate.

BRIEF DESCRIPTION OF THE FIGURES

The foregoing aspects and other features of a washing machine that is configured to detect out of balance masses in a tub rotating at high speed are described in connection with the accompanying drawings.

DETAILED DESCRIPTION

Figure 1:
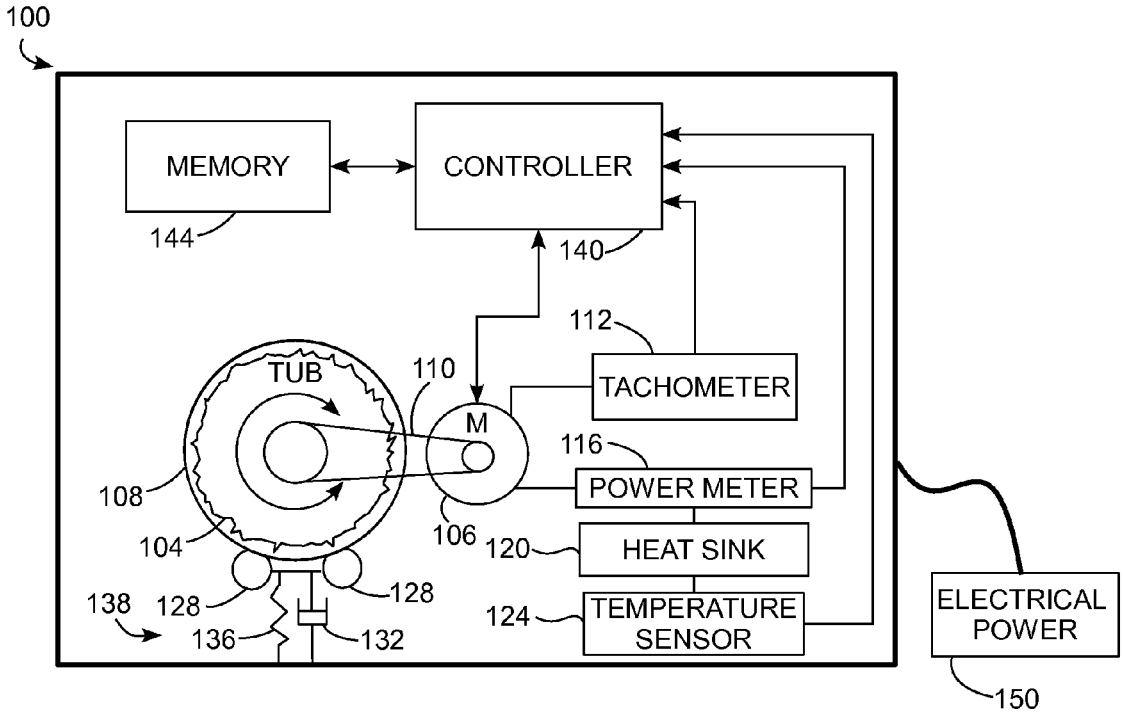
FIG. 1 is a schematic view of components in a washing machine that is configured to identify out of balance loads at high rotational speeds.

For a general understanding of the environment for the system and method disclosed herein as well as the details for the system and method, reference is made to the drawings. In the drawings, like reference numerals have been used throughout to designate like elements. As used herein, the terms "rotational rate," "rotational speed," and "spin speed" are used interchangeably and refer to a number of rotations that a rotating body completes during a given time period, commonly expressed in units of rotations per minute (RPM).

As used herein, the term "tub" refers to a rotating body positioned within a washing machine that is configured to hold articles for the washing machine to wash as well as fluids, such as water and detergent. The contents of a tub are referred to herein as a "load." Various washing machines include tubs that are configured to rotate on a horizontal axis that is substantially parallel to level ground, on a vertical axis that is substantially perpendicular to level ground, or an oblique axis that is arranged at an angle relative to both the horizontal and vertical axes.

Figure 6A:
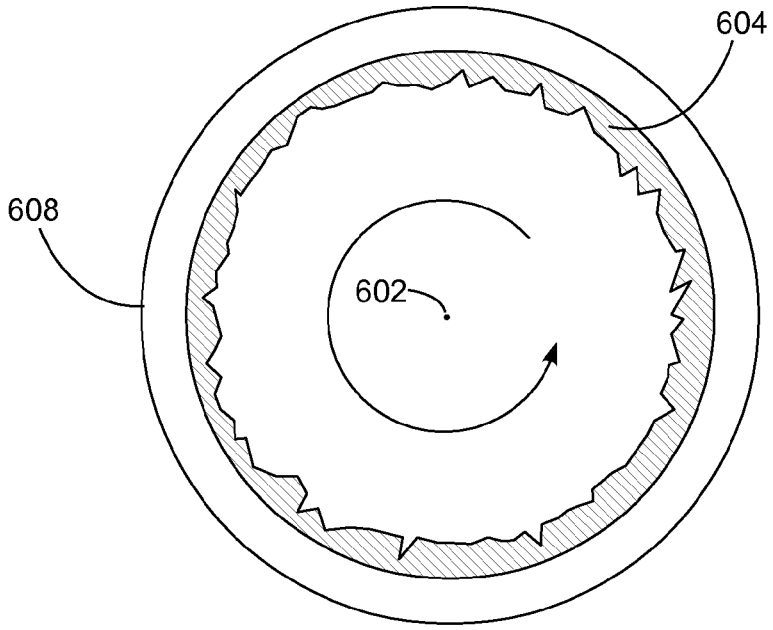
FIG. 6A is a schematic diagram depicting a rotating tub with balanced load.

Many tubs are formed with a generally cylindrical configuration, where a load is placed inside the cylinder. The contents of a tub are referred to herein as a "load." As the tub rotates, centripetal forces exerted on the load urge the load against an inner surface of the cylindrical wall of the tub. At sufficiently high rotational speeds, the load is distributed over some or the entirety of the inner surface of the cylindrical tub. The term "balanced load" refers to a load with a mass that is distributed about the inner surface of the tub wall to enable a substantially uniform centripetal force about the axis of rotation. As shown in FIG. 6A, a rotating tub 608 holds a balanced load 604. Tub 608 rotates about a central axis of rotation 602.

Figure 6B:
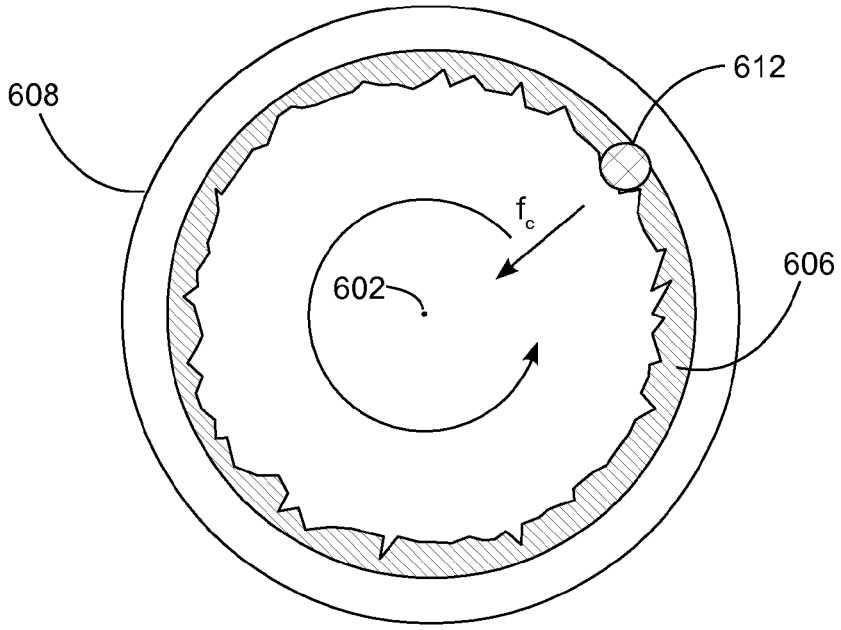
FIG. 6B is a schematic diagram depicting the rotating tub of FIG. 6A with an unbalanced load.

The terms "unbalanced load" and "out of balance load" are used interchangeably and refer to a tub having a load that does not have a substantially uniform centripetal force about the axis of rotation 602. The unbalanced load may be modeled as a point-mass, referred to as an "unbalanced mass." FIG. 6B depicts an unbalanced load with an unbalanced mass 612 positioned on the inner surface of the rotating tub 608. The centripetal force $f_c$ of the unbalanced mass 612 is given by the well-known equation $f_c=mrw^2$. In the preceding equation, m is the mass of the unbalanced mass 612, r is the radial distance between the axis of rotation 602 and the mass 612, and co is the angular velocity of the tub 608, which is often measured in units of radians per second, rotations per second, or rotations per minute. In FIG. 6B, a portion of the load 606 remains distributed in a substantially uniform manner about the tub 608.

In practical embodiments, the distribution of the load and the tolerances of the tub result in tub and load configurations that are not perfectly balanced even when there is no substantial unbalanced mass. Thus, an unbalanced load occurs when an unbalanced mass exceeds a predetermined operating threshold mass, such as one kilogram, for a given rotational rate of the tub. As seen below, practical washing machine embodiments include structures that reduce or eliminate the effects of small unbalanced masses. The centripetal forces generated by an unbalanced load are sufficient to affect the operation of the washing machine.

Figure 2:
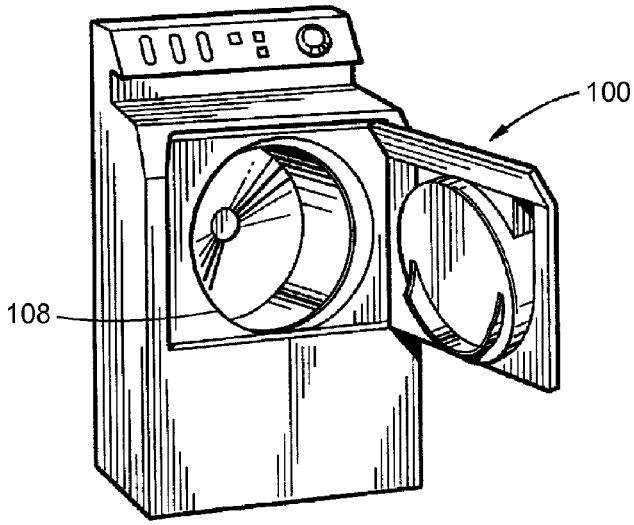
FIG. 2 is an illustration of a washing machine having the configuration of the washing machine of FIG. 1.

FIG. 1 depicts a schematic diagram of a washing machine 100 that is configured to identify a load 104 held in a tub 108 becoming unbalanced. Washing machine 100 includes an electrical motor 106, rotating tub 108, motor tachometer 112, heat sink 120, temperature sensor 124, electrical power meter 116, controller 140, and memory 144. The motor 106 is configured to drive a belt 110 that rotates the tub 108 in either a clockwise or counter-clockwise direction based on the rotational direction of the motor 106. In other embodiments, the motor engages the tub directly to rotate the tub without using an intermediate member such as a belt or gears. The tub 108 is positioned on a suspension system 138 that includes suspension rollers 128, a suspension damper 132, and suspension spring 136. In washing machine 100, the tub 108 is oriented in a horizontal configuration, as illustrated in FIG. 2. In other embodiments, the tub 108 is oriented vertically or obliquely.

The controller 140 is configured to control various subsystems, components and functions of the washing machine 100. In particular, the controller 140 is configured to operate the motor 106, and to receive signals generated by the tachometer 112, power meter 116, and temperature sensor 124. The controller 140 may be implemented with general or specialized programmable processors that execute programmed instructions to configure the controller for particular operations. Controller 140 is operatively connected to memory 144 to enable the controller 140 to read instructions and read and write data required to operate the washing machine 100. The memory 144 can be implemented as a random access memory (RAM) that includes static and dynamic RAM, non-volatile RAM, including flash memory and other solid-state memory technologies, or as a magnetic or optical storage medium. These components may be provided on a printed circuit card or provided as a circuit in an application specific integrated circuit (ASIC). Each of the circuits may be implemented with a separate processor or multiple circuits may be implemented on the same processor.

Alternatively, the circuits may be implemented with discrete components or circuits provided in VLSI circuits. Also, the circuits described herein may be implemented with a combination of processors, ASICs, discrete components, or VLSI circuits.

The tachometer 112 is operatively connected to the motor 106 and the controller 140. The tachometer generates a signal corresponding to the rotational rate of the motor 106, and the controller 140 identifies the rotational rate of the tub 108 with reference to the rotational rate of the motor 106 and a predetermined mechanical advantage between the motor 106 and the tub 108. In an alternative configuration, the controller 140 identifies the rotational rate of either one or both of the motor 106 and tub 108 using indirect techniques that do not require a tachometer or other sensor. A power meter 116 is operatively configured to measure the amount of electrical power that is supplied to the motor 106 from an external power source 150. The amount of electrical power supplied to the motor 106 varies with changes to the rate of rotation and the mechanical load placed on the motor 106. In one embodiment the external power source is an alternating current (AC) source, such as 120V/60 Hz or 220V/50 Hz mains electrical power. During operation, the temperature of the power meter 116 changes and the change in temperature affects the measurements generated by the power meter 116. A heat sink 120 is affixed to the power meter 116 and a temperature sensor 124 is configured to measure the temperature of the heat sink. The controller 140 is configured to receive signals from the power meter 116 that indicate the electrical power applied to the motor 106, and the controller 140 receives signals from the temperature sensor 124. The controller 140 identifies the actual power applied to the motor 106 from the signals generated by the power meter 116 with a correction factor applied with reference to the temperature signals generated by the temperature sensor 124.

The suspension system 138 is configured to absorb energy that results from translational motion of the tub 108 in a vertical and/or horizontal direction. The translational movement is typically generated from a vibration of the rotating tub. An unbalanced load 104 in the rotating tub 108 is one source of translational motion. In the embodiment of FIG. 1, the tub 108 engages rollers 128 that transfer vibrational forces to the spring 136. The damper 132 dissipates the energy that is transferred to the spring 136 to reduce or eliminate horizontal and vertical movement of the rotating tub 108.

In one mode of operation, the controller 140 operates the motor 106 to rotate the tub 108 and load at a low rotational rate. The term "low rotational rate" as applied to the embodiments described herein refers to a rotational rate of the tub 108 that is below two hundred rotations per minute (RPM). More generally, the term "low rotational rate" refers to a rate of rotation of the tub that enables a controller 140 to identify the inertia of the tub and a load positioned in the tub with reference to torque exerted by the motor 106. When the tub 108 operates at a low rotational rate, the suspension system 138 absorbs vibration of the tub 108 and prevents significant vertical and horizontal translational movement of the tub 108. The controller 140 identifies the rotational inertia of the tub 108 and load 104 by measuring the torque exerted by the motor 106. The tub 108 has a predetermined mass and radius, and the controller 140 identifies the mass of the load 104 with reference to the torque and the predetermined parameters of the tub. The controller 140 detects an unbalanced load at low rotational speeds in response to changes in the torque applied to the motor 106. The controller 140 is configured to store a value corresponding to the mass of the load 104 in memory 144 for reference when the tub rotates at a higher rate.

In another mode of operation, the controller operates the motor 106 to rotate the tub 108 at a high rotational rate. As applied to washing machine 100, the term "high rotational rate" refers to a rate of rotation that is above approximately five hundred RPM. More generally, at a high rotational rate, the tub 108 oscillates in a horizontal and/or vertical direction. Washing machines commonly operate at high rotational rates during a spin cycle that extracts fluid held in the load 104. As noted above, the suspension system 138 dampens the oscillation to prevent significant oscillations at low rotational rates, but at a high rotational rate, the suspension system does not completely prevent the tub 108 from oscillating. At higher rotational rates the oscillation of the tub significantly attenuates the amount of information about the forces experienced by the load 104 and tub 108, including information indicating an unbalanced load.

At high rotational rates, the controller 104 identifies the rotational rate of the tub 108 from signals generated by the motor tachometer 112. In an alternative configuration, the controller 104 identifies the rotational rate of the tub 108 using methods that do not require a tachometer or other sensor. As described above, the controller 140 also identifies the power supplied to the motor 106 with reference to the signals generated by the power meter 116 and temperature sensor 124. The memory 144 is preconfigured with a lookup table or other database that stores a plurality of expected power consumption values for the motor 106 when operating at various rotational rates and load mass values. As described below, the controller 140 identifies unbalanced loads in the tub 108 in response to changes in power supplied to the motor 106 and corresponding changes to the balance of a load in the tub 108.

Figure 3:
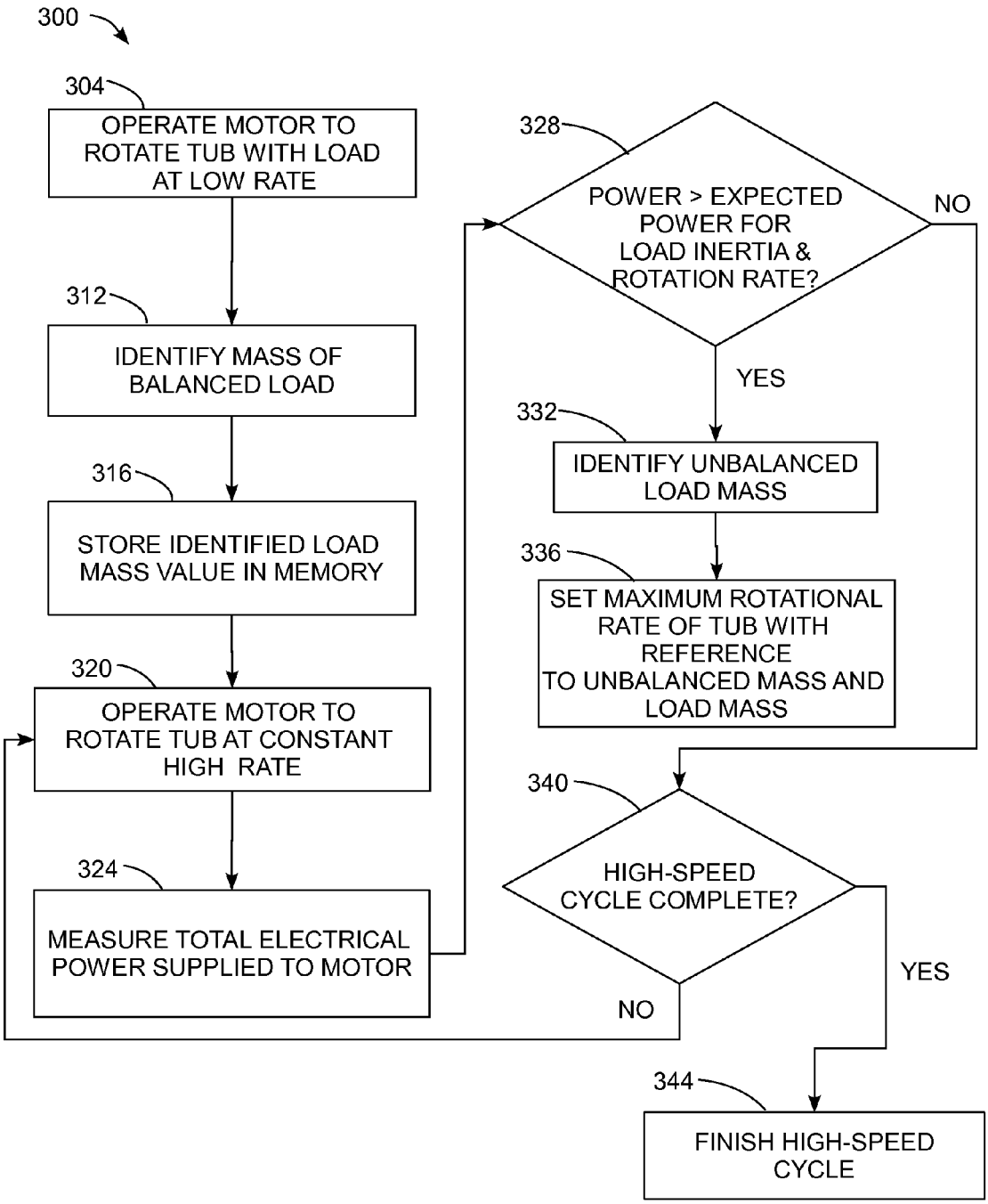
FIG. 3 is a block diagram of a process for identifying an out of balance load during operation of the washing machine of FIG. 1.

FIG. 3 depicts a process 300 for identifying an unbalanced load in a washing machine that is operating at a high rotational rate. For purposes of illustration, process 300 is described in conjunction with the embodiment of the washing machine 100, but alternative washing machine embodiments are also suitable for use with process 300. The controller 140 is configured to perform process 300 using programmed instructions that are stored in the memory 144. Process 300 begins by rotating the tub 108 with a selected load 104 at a predetermined low rate of rotation (block 304). The low rate of rotation enables the load 104 to distribute over the inner surface of the tub 108. Process 300 next identifies the inertia of the tub 108 and load 104 when the load 104 is balanced within the tub 108 (block 312). The controller 140 identifies the mass of the load 104 with reference to the inertia and the torque exerted by the motor 106. If the controller 140 identifies that the load 104 is unbalanced at the low rotational rate, the controller 140 operates the motor 106 to redistribute the load 104 until the load 104 is sufficiently balanced to enable the washing machine 100 to operate with the load 104. The controller 140 stores a value corresponding to the mass of the balanced load in the memory 144 (block 316).

During various modes of operation including a spin cycle, the motor 106 accelerates the tub 108 to rotate at a high rotational rate. The motor 106 is configured to maintain a constant high rotational rate during operation (block 320). In various operating modes of the washing machine 100, the tub 108 rotates at a constant rate of between six hundred RPM and one thousand RPM with various types of loads and washing machine settings. The washing machine may operate at different high rotational rates for different periods of time during a selected cycle as well. Process 300 identifies the electrical power supplied to the motor 106 as the motor 106 rotates the tub 108 at the constant high rotational rate (block 316). In system 100, the controller 140 identifies the electrical power supplied to the motor 106 from the signals generated by the power meter 116 and with a correction factor based on the temperature measured by the temperature sensor 124.

Figure 5A:
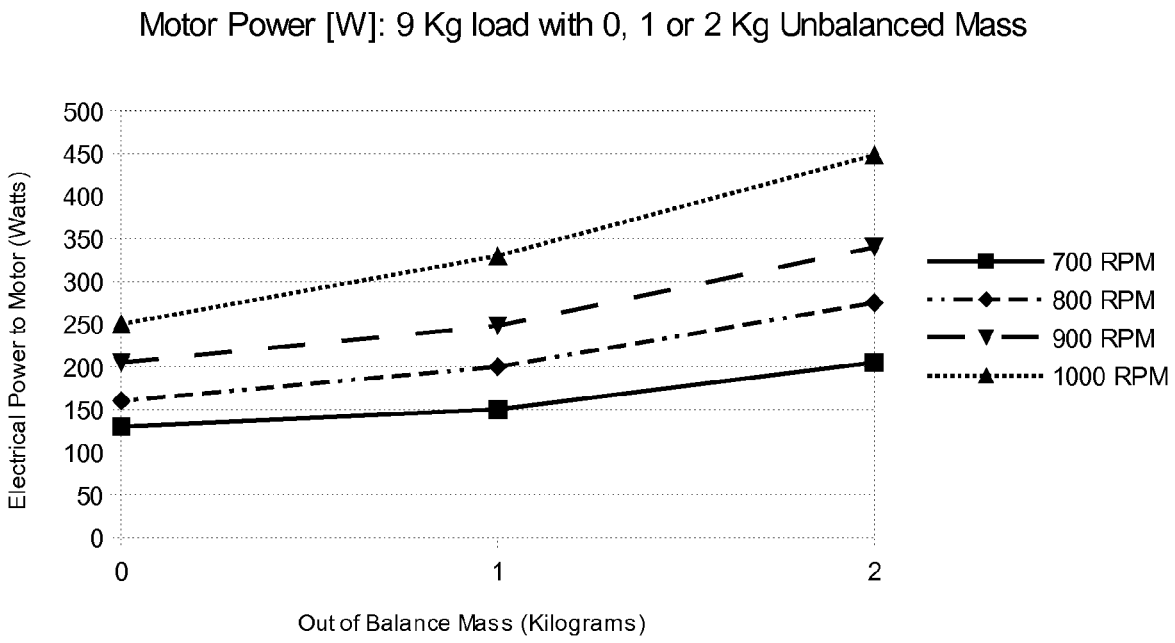
FIG. 5A is a diagram of power consumption at various tub spin speeds and out of balance masses for an example washing machine operating with a nine (9) kilogram load.

Process 300 compares the identified electrical power supplied to the motor 106 to a predetermined expected power for the motor given the identified mass of the balanced load and the rate of rotation of the tub 108 (block 328). For example, FIG. 5A depicts the amount electrical power that a motor in one embodiment consumes to rotate a tub holding a nine kilogram balanced load at 800 RPM. When the load is balanced (zero unbalanced mass), the expected power consumption of the motor 106 is approximately one hundred and sixty watts. When the load is unbalanced, the power consumption of the motor 106 increases in order to maintain the rotational rate of the drum 108. With an unbalanced load, the increased power consumed by the motor 106 to maintain the rotational rate of the tub 108 is converted to oscillation of the tub 108 that is absorbed by the suspension system 138. In the example embodiment, the power consumption with a one kilogram unbalanced mass for the nine kilogram load at 800 RPM is approximately two hundred watts, and for a two kilogram unbalanced mass the power consumption is approximately two hundred and seventy watts.

Figure 5B:
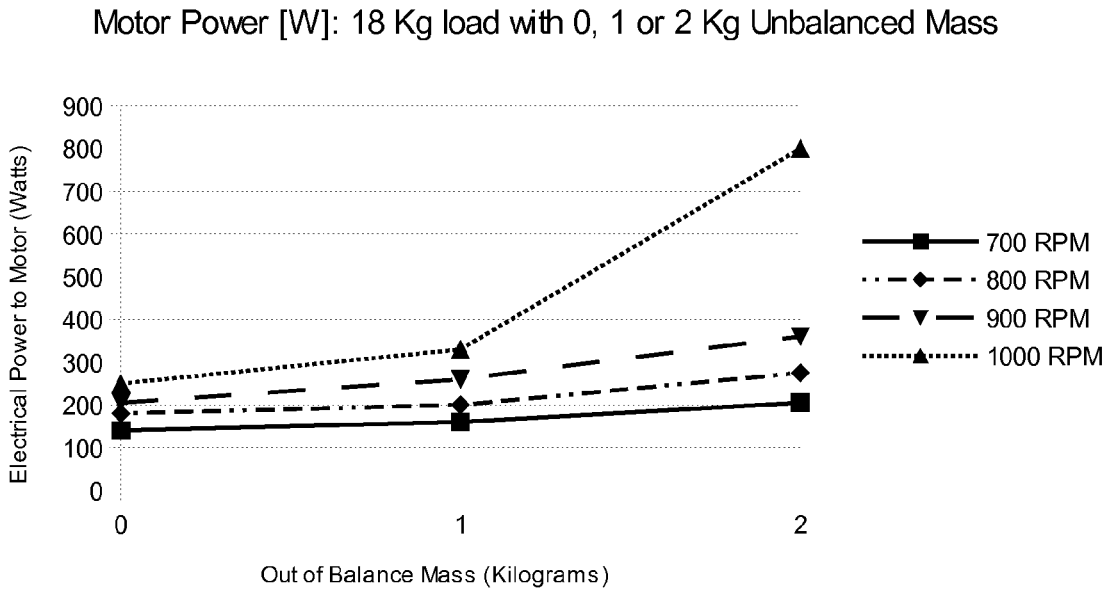
FIG. 5B is a diagram of power consumption at various tub spin speeds and out of balance masses for the example washing machine operating with an eighteen (18) kilogram load.

FIG. 5A and FIG. 5B depict further predetermined power levels for an exemplary washing machine when rotating a tub at constant rotational rates for a nine kilogram and eighteen kilogram load, respectively. FIG. 5A and FIG. 5B illustrate that the power consumption of a motor increases for a given load mass and rotational rate as the out of balance mass increases. Of course, the exact power consumption levels for different washing machine embodiments and configurations may be different from the exemplary embodiment depicted in FIG. 5A and FIG. 5B.

In the washing machine 100, the memory 144 stores one or more tables of power consumption values for the motor 106 for a range of measured tub and load mass values, tub rotation rates, and out of balance masses. The values stored in the memory 144 can be determined empirically and are stored in the memory 144 at the time the washing machine 100 is manufactured. In some configurations, the tables stored in memory 144 include only a partial set of load masses, tub rotational rates, and out of balance masses. For example, the memory 144 may store power measurements for seven hundred RPM and eight hundred RPM tub rotational rates, but not for a rotational rate of seven hundred fifty RPM. In another example, the memory 144 stores expected power consumption data for particular load masses, but the controller may encounter other load masses. For example, expected power consumption data for loads of nine kilograms and eighteen kilograms are stored in the memory 144, but the controller may identify a twenty kilogram load is in the tub 108. To address this issue, the controller 140 is configured to employ various techniques including linear and non-linear interpolation and extrapolation techniques to estimate an expected electrical power consumption of the washing machine even if the memory does not store power consumption data for the exact load mass, tub rotation, or unbalanced mass in the washing machine 100. In some embodiments, the controller uses non-linear techniques, including splines and Gaussian processes, to identify an expected power consumption value for a measured load and tub rotational rate. During process 300, if the controller 140 identifies that the measured power consumption of the motor 106 is greater than the expected power consumption value for a balanced load that is stored in the memory 144, then the controller identifies that the tub 108 and load 104 are unbalanced (block 328).

Process 300 includes an optional process for identifying the size of the out of balanced mass (block 332). The size of the out of balance mass is identified with reference to the power consumption values stored in the memory 144. For example, as depicted in FIG. 5A, the power consumption level at 800 RPM with a one kilogram unbalanced mass is approximately 200 watts, while the power consumption with a two kilogram unbalanced mass is 270 watts. The controller 140 is configured to identify the magnitude of the difference between the power consumption when operating with a balanced load and the increased power consumption, and to identify an estimate of the unbalanced mass with reference to the power consumption values stored in the memory 144. In another configuration, the controller simply identifies that the load is unbalanced with reference to the power consumption of the motor and predetermined power consumption value for a given load inertia and tub rotational rate.

Process 300 responds to the identification of an unbalanced load by reducing the maximum rotational rate for the tub 108 (block 336). The maximum rotational rate of the tub 108 is lowered to prevent mechanical wear, excessive noise, or damage to the washing machine 100 or the surroundings of the washing machine 100 when the tub 108 rotates with an unbalanced mass. In some configurations, the tub returns to a low spin rate that enables the unbalanced load to redistribute in the tub to correct the unbalanced condition. In other embodiments, the maximum rotational rate of the tub enables the tub to continue rotation at a high rotational rate that is suited to the size of the unbalanced mass and the total inertia of the load. For example, in one washing machine embodiment a spin cycle operates at nine hundred RPM with a balanced a nine kilogram load, but continues at a rate of seven hundred RPM when a one kilogram unbalanced mass is detected. If a two kilogram unbalanced mass is detected, the washing machine returns to a low spin rate to redistribute the load mass.

Process 300 monitors the power consumption of the motor 106 continuously during operation of the washing machine, and the tub rotates at the constant high rotational rate when the identified power consumption of the motor 106 corresponds to the expected power consumption for a balanced load (block 328). The monitoring process continues during the high speed cycle (blocks 340 and 320) until the high speed cycle is completed and the controller 140 operates the motor 106 and tub 108 at a low rotational rate (block 344).

Figure 4:
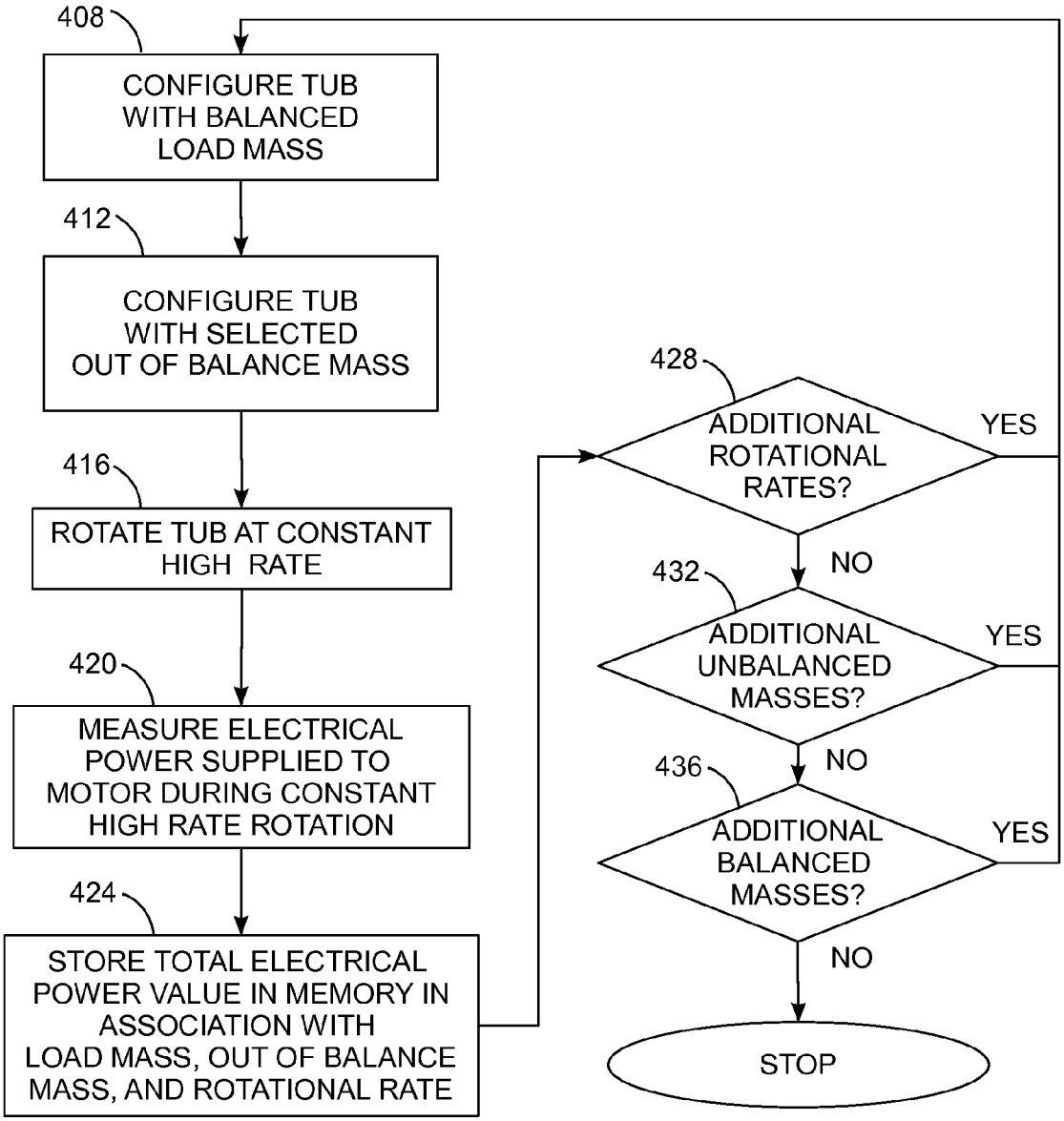
FIG. 4 is a block diagram of a process for characterizing power usage of a washing machine while operating with various loads and out of balance masses.

FIG. 4 depicts a process 400 for characterizing the operation of a washing machine to identify unbalanced loads in the washing machine when the washing machine rotates a tub at high rotational rates. For purposes of illustration, process 400 is described in conjunction with the embodiment of the washing machine 100, but alternative washing machine embodiments are also suitable for use with process 400. Process 400 begins by placing a predetermined balanced mass (block 408) and a predetermined unbalanced mass (block 412) in the tub 108. The balanced load mass is formed to distributed evenly on the inner surface of the tub 108, such as a ring of material or articles that distribute evenly in the tub 108. The unbalanced mass is typically a compact mass such as a weight that generates an unbalanced centripetal force when the tub 108 rotates. The sum of the balanced load mass and unbalanced load mass is selected to simulate a load mass that the washing machine handles during regular operation. To characterize the operation of the washing machine 100 with a balanced load, the unbalanced mass can be zero. Additionally, process 400 can be performed with only an unbalanced mass to characterize various unbalanced loads that may occur due to imbalances that are formed in the tub 108 during manufacture or operation.

Process 400 continues by rotating the tub 108 at a selected constant high rate (block 416). Motor 106 accelerates the tub 108 and the configured load to the high rate. As described above, the high rotational rates for the washing machine 100 are typically above five hundred RPM. After the acceleration phase, process 400 measures the electrical power that is supplied to the motor 106 as the motor 106 continues to rotate the tub 108 at the constant rotational rate. The power supplied to the motor 106 changes based on the selected balanced mass, unbalanced mass, and rotational rate. A value corresponding to the measured electrical power is stored in the memory 144 in association with the selected balanced mass, unbalanced mass, and rotational rate (block 424).

Process 400 continues to characterize the power consumption of the motor 106 at various rotational rates (block 428), unbalanced load masses (block 432), and balanced load masses (block 436). As depicted in FIG. 5A and FIG. 5B, multiple power levels are identified for different load sizes, unbalanced masses, and rotational rates. In one operating mode, process 400 is performed using one or more sample washing machines having a common design. The values for electrical power consumption of the motor that are stored in the memory of the sample washing machines are copied into the memories of all washing machines having the same design during manufacture. Thus, process 400 can be performed on a limited number of washing machines to provide unbalanced load detection data for all washing machines that have a common design. The motor power consumption values that are identified in process 400 can be used with process 300.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating a washing machine comprising:
operating a motor to rotate a tub holding a load at a first rotational rate, the first rotational rate being less than a first predetermined threshold rotational rate and being greater than a rotational rate that enables the load to remain in contact with an inner surface of the rotating tub;
identifying a torque applied by the motor to continue to rotate the tub at the first rotational rate;
identifying a mass of the load with reference to the torque and the first rotational rate;
operating the motor to rotate the tub at a second rotational rate, the second rotational rate being greater than the first predetermined threshold rotational rate;
identifying an electrical power level applied to the motor to continue rotation of the tub at the second rotational rate;
obtaining an out of balance mass value from a memory with reference to the identified electrical power level applied to the motor, the second rotational rate, and the identified mass;
identifying a maximum rotational rate for the tub with reference to the out of balance mass value; and
operating the motor to rotate the tub at a third rotational rate that is less than or equal to the identified maximum rotational rate and the third rotational rate being greater than the first predetermined threshold rotational rate.

2. The method of claim 1, wherein the third rotational rate is less than the first rotational rate.

3. The method of claim 1, wherein the first predetermined threshold rotational rate is a rotational rate that enables the tub to move in a linear manner with respect to a suspension.

4. A washing machine comprising:
a rotatable tub having a volume for holding a load;
a suspension operatively connected to the tub, the suspension being configured to dampen linear movement of the tub;
an electrical motor operatively connected to the rotatable tub and configured to rotate the tub at a plurality of rotational rates;
a power sensor configured to identify an amount of electrical power consumed by the motor during rotation of the tub; and
a controller operatively connected to the motor, power sensor, and a memory, the controller being configured to:
operate the motor to rotate the tub holding a load at a first rotational rate, the first rotational rate being less than a first predetermined threshold rotational rate and being greater than a rotational rate that enables the load to remain in contact with an inner surface of the rotating tub, the first predetermined threshold rotational rate being between five hundred rotations per minute and seven hundred fifty rotations per minute;
identify a torque applied by the motor to continue rotation of the tub at the first rotational rate;
identify a mass of the load with reference to the torque and the first rotational rate;
operate the motor to rotate the tub at a second rotational rate, the second rotational rate being above the first predetermined threshold rotational rate;
identify an electrical power level applied to the motor to continue rotation of the tub at the second rotational rate;
identify an out of balance mass value of the load with reference to the electrical power level applied to the motor, the second rotational rate, and the identified mass of the load;
identify a maximum rotational rate for the tub with reference to the out of balance mass value and the identified mass of the load; and
operate the motor to rotate the tub at a third rotational rate that is less than or equal to the identified maximum rotational rate.

5. The washing machine of claim 4 further comprising:
a temperature sensor configured to generate a signal corresponding to a temperature of the power sensor, the controller being operatively connected to the temperature sensor and further configured to identify the electrical power level applied to the motor with reference to the electrical power identified by the power sensor during rotation of the tub and the temperature of the power sensor.

6. The washing machine of claim 4, wherein the third rotational rate is less than the first rotational rate.

7. The washing machine of claim 4, wherein the first predetermined threshold rotational rate is a rotational rate that enables the tub to move in a linear manner with respect to a suspension.

8. The washing machine of claim 4, the controller being further configured to:
operate the motor to rotate the tub at a predetermined rotational rate that enables the tub to move in a linear manner with respect to the suspension, the tub holding a second load having a first predetermined mass and an object having a second predetermined mass, the second load being configured to distribute in a substantially uniform manner on an internal surface of the tub in response to rotation of the tub and the object being configured to generate an unbalanced force on the tub in response to rotation of the tub;

identify an electrical power level applied to the motor to continue rotation of the tub at the predetermined rotational rate; and store a value corresponding to the second predetermined mass in the memory in association with the predetermined rotational rate, the first predetermined mass, and the identified electrical power level applied to the motor to continue rotation of the tub at the predetermined rotational rate.

9. The washing machine of claim 8, the controller being further configured to:

operate the motor to rotate the tub at a second predetermined rotational rate that is greater than the predetermined rotational rate, the tub holding the second load having the first predetermined mass and the object having the second predetermined mass;

identify a second electrical power level applied to the motor to continue rotation of the tub at the second predetermined rotational rate; and store a value corresponding to the second predetermined mass in the memory in association with the second predetermined rotational rate, the first predetermined mass of the second load, and the second identified electrical power level applied to the motor to continue rotation of the tub at the second predetermined rotational rate.

* * * * *